US008739541B2

(12) United States Patent
Ast et al.

(10) Patent No.: US 8,739,541 B2
(45) Date of Patent: Jun. 3, 2014

(54) SYSTEM AND METHOD FOR COOLING AN EXPANDER

(75) Inventors: Gabor Ast, Garching (DE); Sebastian Walter Freund, Unterföhring (DE); Thomas Johannes Frey, Ingolstadt (DE); Pierre Sebastien Huck, Munich (DE); Herbert Kopecek, Hallbergmoos (DE); Günther Wall, Bad Häring (AT)

(73) Assignee: General Electric Company, Niskayuna, NY (US)

( * ) Notice: Subject to any disclaimer, the term of this patent is extended or adjusted under 35 U.S.C. 154(b) by 629 days.

(21) Appl. No.: 12/892,973

(22) Filed: Sep. 29, 2010

(65) Prior Publication Data

US 2012/0073289 A1 Mar. 29, 2012

(51) Int. Cl.

| | |
|---|---|
| ***F01K 13/00*** | (2006.01) |
| ***F01K 17/00*** | (2006.01) |
| ***F01K 25/08*** | (2006.01) |
| ***F01K 25/00*** | (2006.01) |

(52) U.S. Cl.
USPC ..... 60/677; 60/651; 60/671

(58) Field of Classification Search
USPC ..... 60/645–681; 415/180
See application file for complete search history.

(56) References Cited

U.S. PATENT DOCUMENTS

| | | | | |
|---|---|---|---|---|
| 1,678,065 | A * | 7/1928 | Lamb | 415/116 |
| 1,678,066 | A * | 7/1928 | Lamb | 415/116 |
| 2,384,587 | A * | 9/1945 | Phillips | 60/657 |
| 3,029,197 | A * | 4/1962 | Untermyer | 376/209 |
| 3,100,967 | A * | 8/1963 | Brunner | 60/658 |
| 3,173,654 | A * | 3/1965 | Roe | 415/1 |
| 3,292,366 | A * | 12/1966 | Rice et al. | 60/651 |
| 3,979,914 | A * | 9/1976 | Weber | 376/402 |
| 4,008,573 | A * | 2/1977 | Petrillo | 60/651 |
| 4,363,216 | A * | 12/1982 | Bronicki | 60/657 |
| 5,329,771 | A | 7/1994 | Kytomaki et al. | |
| 5,421,157 | A | 6/1995 | Joel | |
| 5,555,731 | A | 9/1996 | Joel | |
| 7,100,380 | B2 | 9/2006 | Brasz et al. | |
| 2010/0034684 | A1 * | 2/2010 | Ast et al. | 418/84 |

FOREIGN PATENT DOCUMENTS

DE 102007008609 A1 8/2008

OTHER PUBLICATIONS

International Search Report and Written Opinion issued in connection with corresponding PCT Application No. PCT/US2011/046100 dated Nov. 27, 2013.

* cited by examiner

*Primary Examiner* — Christopher Jetton
(74) *Attorney, Agent, or Firm* — Ann M. Agosti

(57) ABSTRACT

A Rankine cycle system includes: an evaporator configured to receive heat from a heat source and circulate a working fluid to remove heat from the heat source; an expander in flow communication with the evaporator and configured to expand the working fluid fed from the evaporator; a condenser in flow communication with the expander and configured to condense the working fluid fed from the expander; a pump in flow communication with the condenser and configured to pump the working fluid fed from the condenser; a first conduit for feeding a first portion of the working fluid from the pump to the evaporator; and a second conduit for feeding a second portion of the working fluid from the pump to the expander.

11 Claims, 6 Drawing Sheets

SYSTEM AND METHOD FOR COOLING AN EXPANDER

BACKGROUND

The embodiments disclosed herein relate generally to the field of Rankine cycle systems and, more particularly, to systems and methods for cooling expander components.

Rankine cycle systems are used to convert heat into electrical power. Traditional Rankine cycle systems create the heat by combustion of coal, natural gas, or oil and use a steam based working fluid. Organic Rankine cycle systems use a higher molecular mass organic working fluid than is used with the more traditional steam Rankine cycle systems. ORC systems may be used for heat recovery from low temperature heat sources such as industrial waste heat, engine exhaust, geothermal heat, photovoltaic systems, or the like. The recovered low temperature heat may be used to generate electricity, for example. Typically a closed loop system is used wherein the working fluid is pumped through an evaporator where the working fluid is evaporated, is pumped through at least one expander where energy is extracted, is pumped through a condenser where the working fluid is re-condensed, and is then pumped back into the evaporator.

In an ideal ORC, the expansion is isentropic, whereas the evaporation and condensation processes are isobaric. As a practical matter, during expansion, only a portion of the energy recoverable from the enthalpy difference is transformed into useful work. Increasing the temperature at the inlet of an expander increases the efficiency of the ORC system. Increasing the inlet temperature, however, also increases the temperature of the expander components. Some of the expander components may not be able to withstand the temperature of the thermodynamic optimum for ORC system efficiency.

It would be desirable to have a system and method that improves efficiency and power output of an ORC system.

BRIEF DESCRIPTION

In accordance with one embodiment disclosed herein, a Rankine cycle system comprises: an evaporator configured to receive heat from a heat source and circulate a working fluid to remove heat from the heat source; an expander in flow communication with the evaporator and configured to expand the working fluid fed from the evaporator; a condenser in flow communication with the expander and configured to condense the working fluid fed from the expander; a pump in flow communication with the condenser and configured to pump the working fluid fed from the condenser; a first conduit for feeding a first portion of the working fluid from the pump to the evaporator; and a second conduit for feeding a second portion of the working fluid from the pump to the expander.

In accordance with another embodiment disclosed herein, a Rankine cycle system comprises: an evaporator configured to receive heat from a heat source and circulate a working fluid to remove heat from the heat source; a first expander in flow communication with the evaporator and configured to expand the heated working fluid fed from the evaporator; a second expander in flow communication with the first expander and configured to expand the working fluid fed from the first expander; a condenser in flow communication with the second expander and configured to condense the working fluid fed from the second expander; a pump in flow communication with the condenser configured to pump the working fluid fed from the condenser; a first conduit for feeding a first portion of the working fluid from the pump to the evaporator; and a second conduit for feeding a second portion of the working fluid from the pump to at least one of the first expander, the second expander, and an expander conduit in-between the first expander and the second expander.

In accordance with one exemplary embodiment disclosed herein, a method of operating a Rankine cycle system comprises: circulating a working fluid in an evaporator in heat exchange relationship with the heat source so as to vaporize the working fluid; expanding the vaporized working fluid in an expander; condensing the expanded working fluid via a condenser fed from the expander; pumping the condensed working fluid; supplying a first portion of the pumped working fluid to the evaporator; and supplying a second portion of the condensed working fluid directly to the expander.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

As discussed in detail below, embodiments of the present invention provide a Rankine cycle system having an evaporator to receive heat from a heat source to heat a working fluid. In one embodiment, the Rankine cycle comprises an organic Rankine cycle (ORC). The system includes an expander in flow communication with the evaporator and configured to expand the working fluid fed from the evaporator. The expander may comprise a single stage expander or a multi stage expander. The system further includes a condenser in flow communication with the expander and configured to condense the working fluid fed from the expander. A pump is in flow communication with the condenser and configured to pump the working fluid fed from the condenser. At least two conduits are coupled to the pump to feed the working fluid. A first conduit is coupled to feed a first portion of the working fluid to the evaporator and a second conduit is coupled to feed the second portion of the working fluid to the expander. A method for operating a Rankine cycle system is also disclosed. Unless defined otherwise, the terms "first", "second", and the like, as used herein do not denote any order, quantity, or importance, but rather are used to distinguish one element from another. Also, the terms "a" and "an" do not denote a limitation of quantity, but rather denote the presence of at least one of the referenced items. Similarly "two" or "three"

are not intended to denote a limitation of quantity and are intended to be read as "at least two" or "at least three." The use of "including," "comprising" or "having" and variations thereof herein are meant to encompass the items listed thereafter and equivalents thereof as well as additional items. The present invention is described with the example of organic Rankine cycle (ORC), but the invention is equally applicable to other Rankine cycle systems.

Figure 1:
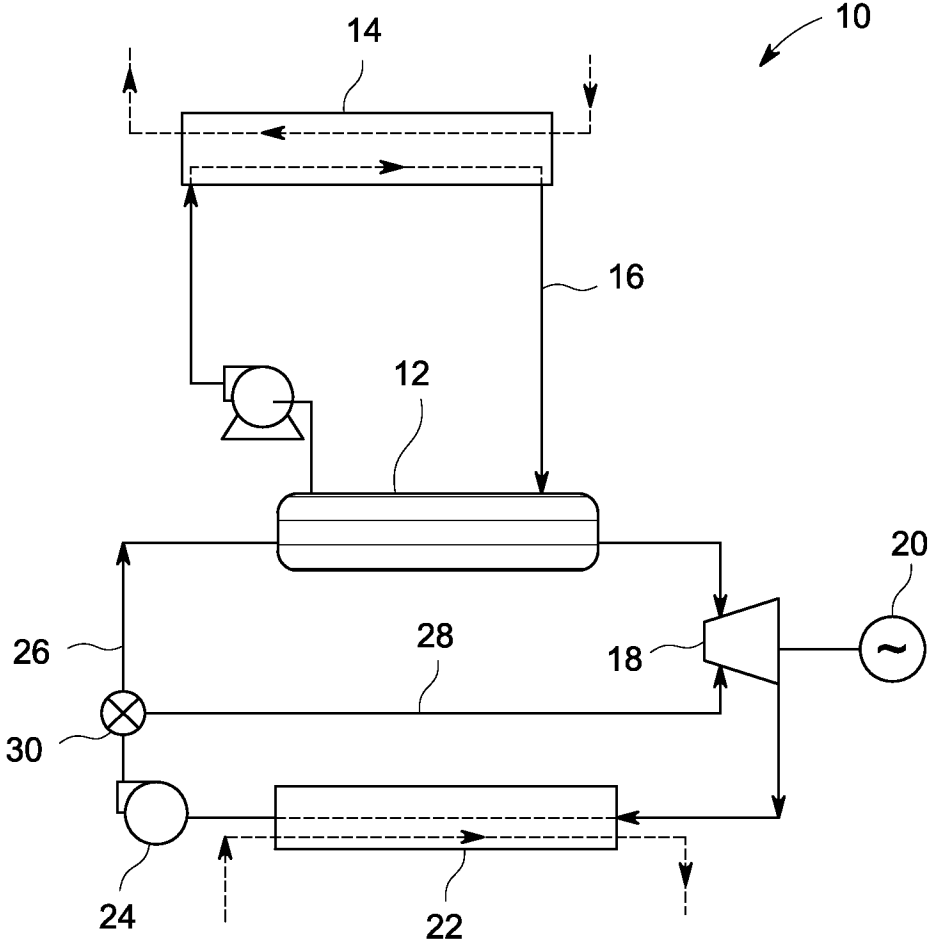
FIG. 1 is a diagrammatical representation of an organic Rankine cycle (ORC) system in accordance with an exemplary embodiment disclosed herein.

Referring to FIG. 1, a Rankine cycle system 10 is illustrated in accordance with an exemplary embodiment of the present invention. The illustrated Rankine cycle system 10 comprises an ORC system and includes an evaporator 12 through which organic working fluid is circulated. The organic working fluid may comprise cyclohexane, isopentane, cyclopentane, butane, thiophene, or combinations thereof, for example. The evaporator 12 is coupled to a heat source 14 via an intermediate loop 16. The heat source 14 may comprise, for example, an exhaust heat exchanger coupled to an engine. In one example, the temperature of the exhaust unit of the engine may be in the temperature range of 400 to 500 degrees Celsius. The evaporator 12 receives heat from the exhaust gas generated from the heat source 14 via the intermediate loop 16 and generates a vaporized organic working fluid. The vaporized organic working fluid is passed through an expander 18 (which in one example comprises a radial type expander) to drive a generator unit 20. In certain other exemplary embodiments, the expander may comprise an axial type expander, impulse type expander, or high temperature screw type expander. The exemplary expander 18 may comprise a single-stage expander or a multi-stage expander. After passing through the expander 18, the organic working fluid is at a relatively lower pressure and lower temperature and is then passed through a condenser 22 where the working fluid is re-condensed into a condensed working fluid. A pump 24 is coupled in flow communication with the condenser 22 and configured to pump the working fluid fed from the condenser 22. The pump 24 feeds a first portion of the condensed working fluid to the evaporator 12 via a first conduit 26 and a second portion of the condensed working fluid to the expander 18 via a second conduit 28. A flow control means such as a valve 30 is provided to control the flow of the working fluid through the first conduit 26 and the second conduit 28.

Figure 2:
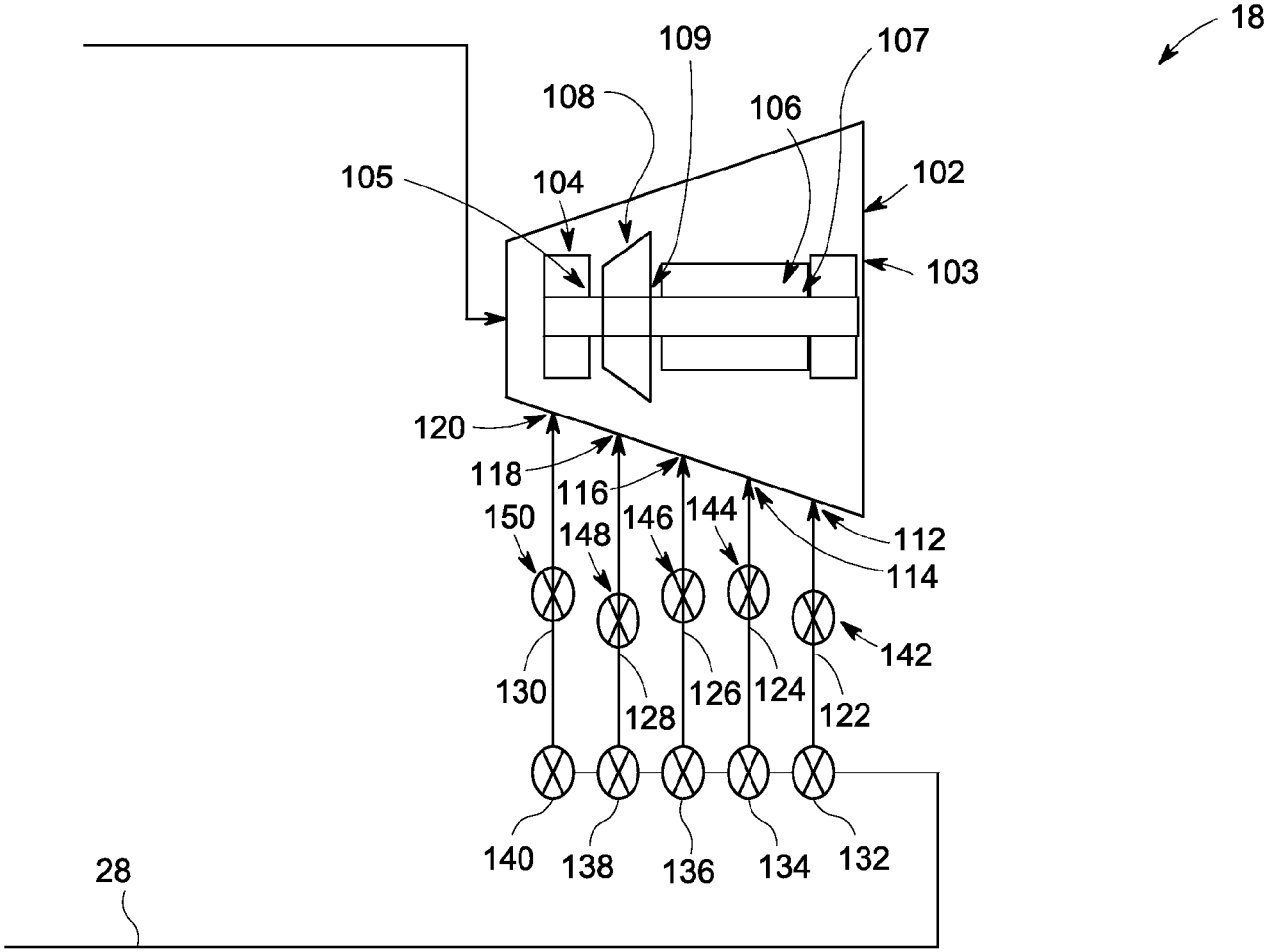
FIG. 2 is a diagrammatical representation of an enlarged view of an expander in accordance with an exemplary embodiment disclosed herein.

In the illustrated embodiment, the second portion of the working fluid fed to the expander through the second conduit 28 is used to cool at least one of the expander components. Various expander components are illustrated in FIG. 2 such as a casing 102, a bearing 104, a shaft 106, and an impeller 108. These components are heated during operation and require cooling to operate without sacrificing the efficiency and power of the ORC cycle. The working fluid, which is in liquid condition after exiting the condenser, is at relatively low temperature as compared to the temperature of the working fluid at the inlet of the expander and may be fed at one location or more than one locations within the expander 18.

FIG. 2 illustrates a detailed view wherein the expander 18 comprises a casing 102 which houses a bearing 104, a shaft 106, and an impeller 108. In conventional ORC systems, the temperature capacity of the bearing 104, the shaft 106, and the impeller 108 limits the increase that is acceptable in the inlet temperature of the working fluid. In the illustrated embodiment of FIG. 2, in accordance with one embodiment of the invention, the second conduit 28 is branched off through branches 122, 124, 126, 128 and 130 that are coupled to the casing 102 at a plurality of locations 112, 114, 116, 118 and 120. The number of branches shown in the current embodiment is exemplary and is not intended to limit the scope of the invention. In other embodiments the number of branches can vary depending on the application. Coupling to the casing may be accomplished by a mechanical fastener or flanges or by welding or brazing for example. The second conduit 28 is may be split on the branches 122, 124, 126, 128 and 130 via a device such as one or more taps 132, 134, 136, 138 and 140. If desired, additional flow regulating devices 142, 144, 146, 148 and 150 such as valves may be included in the branches 122, 124, 126, 128 and 130. In one embodiment, the regulating devices 142, 144, 146, 148 and 150 regulate the flow of the second portion of the working fluid based on the sensed temperature of the expander components such as the bearing, the impeller, the shaft and the casing of the expander. The temperature may be sensed by sensors 103, 105, 107 and 109 which are placed for purposes of example in the casing 102 and near the bearing 104, the shaft 106, and the impeller 108 respectively. The amount of the working fluid that is provided to cool the corresponding components of the expander 18 may be regulated based on the sensed temperatures.

The regulating devices, 142, 144, 146, 148 and 150 in one embodiment comprise valves with a control mechanism for controlling the opening of the valves. The valves may be fully opened, or partially opened, or closed depending on the temperature of the corresponding expander components. For example, if the temperature of the bearing 104 exceeds a predefined threshold, the temperature of the shaft 106 exceeds a predefined critical temperature, the temperature of the impeller 108 is near to the critical temperature, and the temperature of the casing 102 is within the permissible range, then the regulating devices 150, 146 are fully opened, the regulating device 144 is partially opened, and the regulating devices 142 and 148 are closed. In another embodiment, rather than using sensors, the temperature of the expander components may be calculated based on the empirical experiments or a model-based approach. In one embodiment, a model is based on mathematical equations and thermodynamic properties to describe the temperature of the modeled components based on the inlet temperature, pressure, and mass flow.

Referring back to FIG. 1, the valve 30, in one embodiment, has at least two openings corresponding to first and second conduits 26 and 28 and a control mechanism to control the flow in each of the conduits 26 and 28. In one embodiment, the control mechanism controls the flow based on the temperature of the expander components such as the bearing 104, the impeller 108, the casing 102 and the shaft 106 of the expander. For example, if the temperature of the expander components is below the critical temperature, then the valve 30 will remain closed with respect to second conduit 28, or, if at least one component's temperature exceeds the critical temperature, the valve 30 will open. The amount of working fluid, which flows in second conduit 28, is, in one example, between 0.3% to 1% mass flow of the working fluid circulating in the ORC system.

Figure 3:
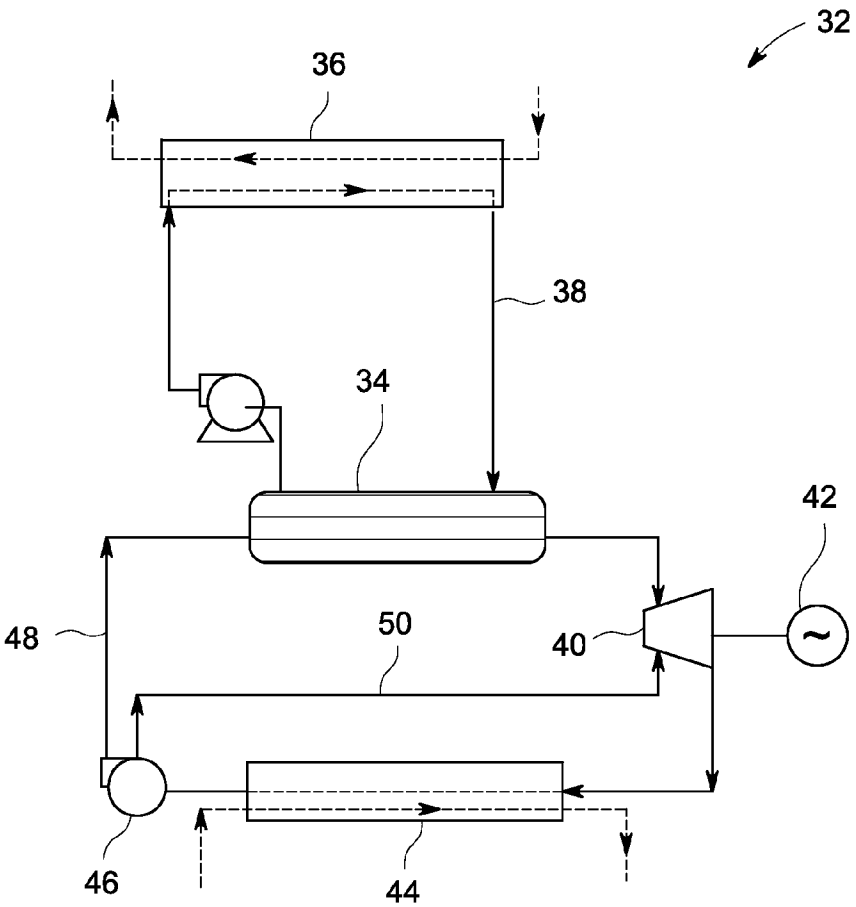
FIG. 3 is a diagrammatical representation of an ORC system in accordance with an another exemplary embodiment disclosed herein.

Referring to FIG. 3, an ORC system 32 is illustrated in accordance with another exemplary embodiment of the present invention. The illustrated ORC system 32 includes an evaporator 34 through which organic working fluid is circulated. The evaporator 34 is coupled to a heat source 36 such as, for example, an exhaust heat exchanger coupled to an engine. The evaporator 34 receives heat from the exhaust gas generated from the heat source 36 via an intermediate loop 38 and generates a vaporized organic working fluid. The vaporized organic working fluid is passed through an expander 40 to drive a generator unit 42. The exemplary expander 40 may comprise a single stage expander or multi-stage expander. After passing through the expander 40, the organic working fluid is at a relatively lower pressure and lower temperature and is then passed through a condenser 44 for condensing the working fluid. A pump 46 is in flow communication with the condenser 44 and configured to pump the working fluid fed from the condenser 44. In the illustrated embodiment, the pump 46 has two openings 48 and 50 to feed the condensed working fluid. A first opening 48 is used to feed a first portion of the working fluid to the evaporator 34, and a second opening 50 is used to feed a second portion of the working fluid to the expander 40. In the ORC system 32 of FIG. 3, the pump 46 comprises a control mechanism to control the flow in each of the conduits 48 and 50. The control mechanism may control the flow based on the temperature of the expander components as discussed above with respect to the embodiment of FIG. 1.

Figure 4:
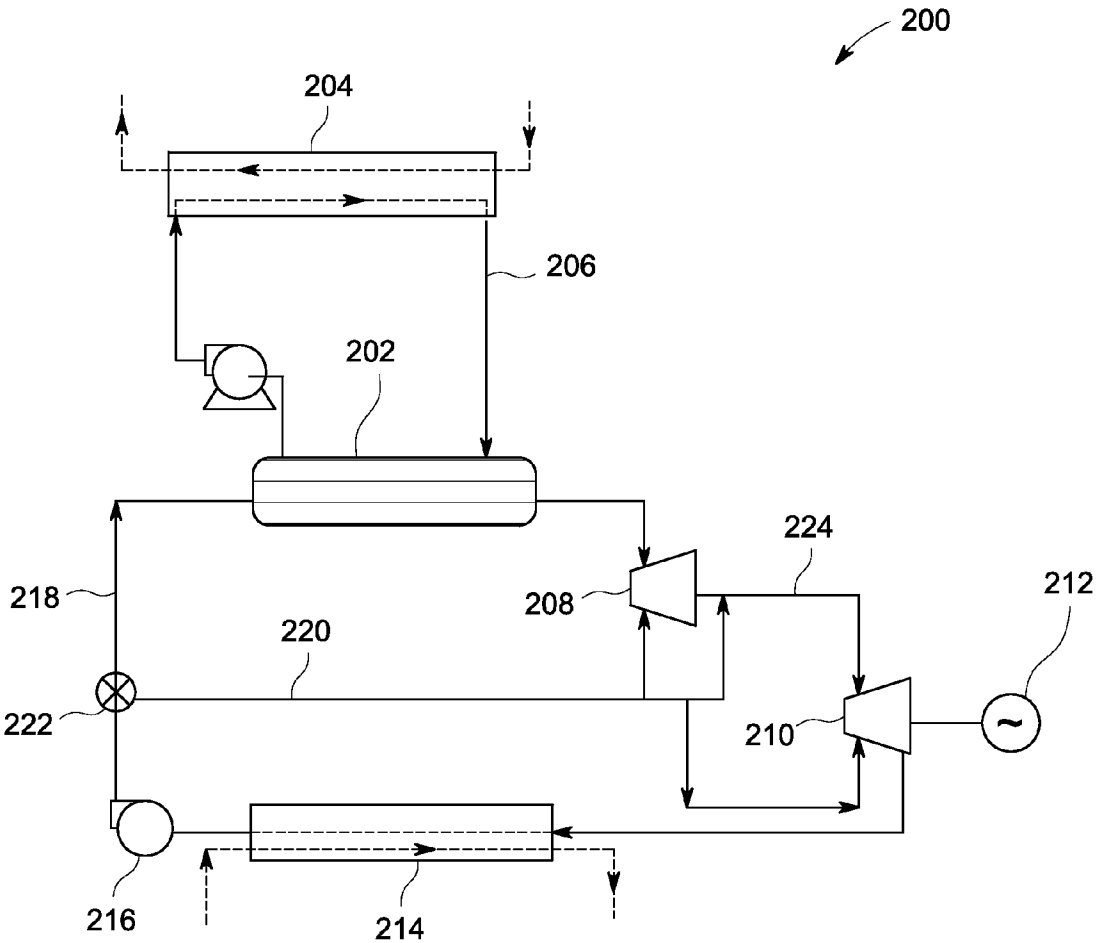
FIG. 4 is a diagrammatical representation of an ORC system having two expanders in accordance with an exemplary embodiment disclosed herein.

Referring to FIG. 4, an ORC system 200 is illustrated in accordance with another exemplary embodiment of the present invention. An evaporator 202 is coupled to a heat source 204 such as, for example, an exhaust heat exchanger coupled to an engine. The evaporator 202 receives heat from the exhaust gas generated from the heat source 204 via an intermediate loop 206 and generates a vaporized organic working fluid. The vaporized organic working fluid is passed through a first expander 208 and then a second expander 210. The second expander 210 is in flow communication with the first expander 208 and configured to expand the organic working fluid from the first expander 208 to drive a generator unit 212. The first expander 208 and the second expander 210 collectively form a multi-stage expander in this embodiment. There may be other multiphase expander embodiments wherein multiple stages of an expander are situated in one expander element. The exemplary expanders 208 and 210 of FIG. 4 may themselves comprise single stage expanders or multi-stage expanders. In some embodiments, the first expander 208 may also drive an additional generator unit (not shown). After passing through the second expander 210, the organic working fluid is at a relatively lower pressure and lower temperature than when the fluid left the evaporator and is passed through a condenser 214. A pump 216 is coupled in flow communication with the condenser 214 and configured to pump the working fluid fed from the condenser 214. The pump 216 feeds a first portion of the condensed working fluid to the evaporator 202 via a first conduit 218 and a second portion of the condensed working fluid to at least one of the first expander 208, second expander 210, and a conduit 224 in between the first expander and the second expander via a second conduit 220. A regulating device such as, for example, a valve 222 may be provided to control the flow of the working fluid through the first conduit 218 and the second conduit 220.

Figure 5:
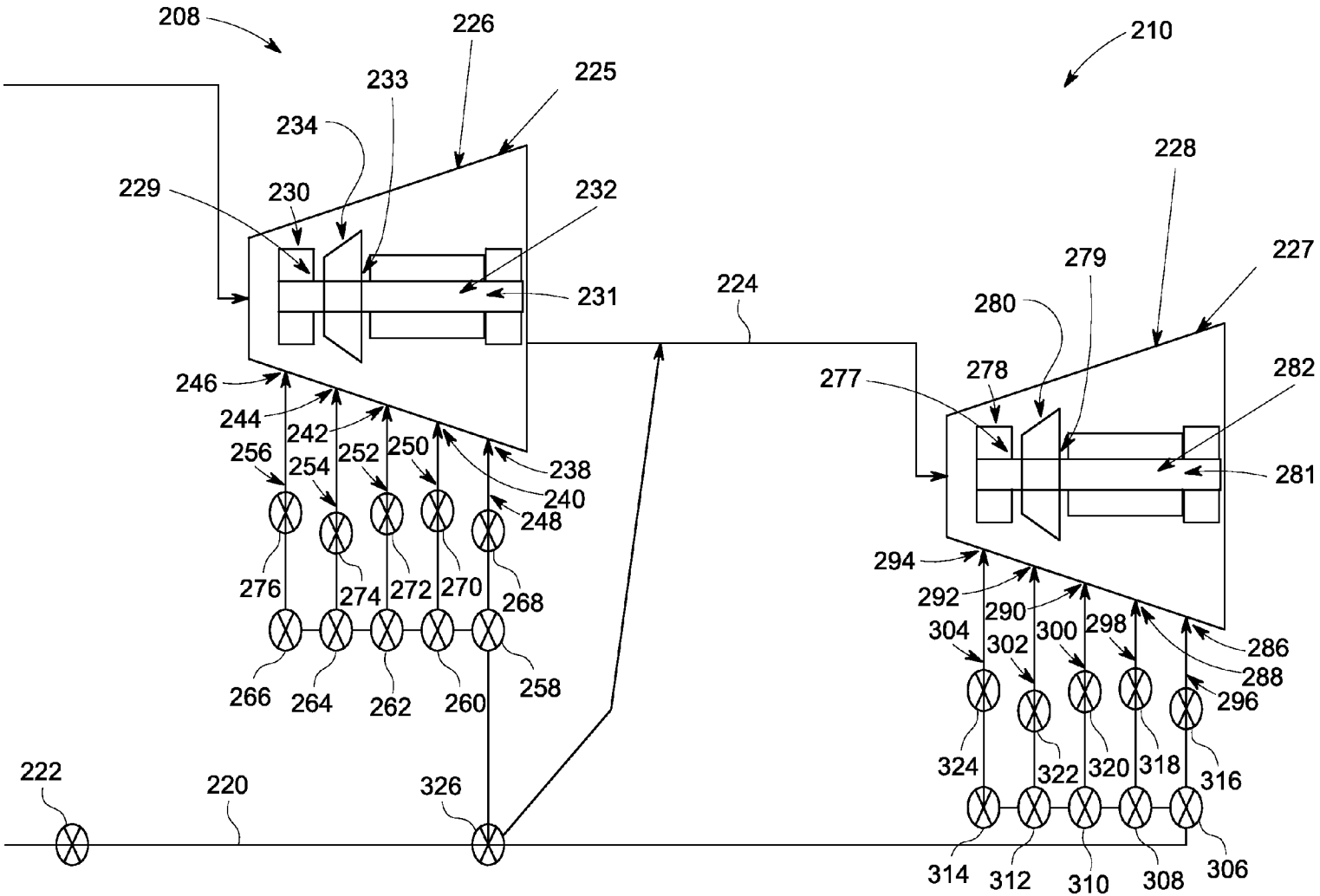
FIG. 5 is a diagrammatical representation of an enlarged view of two expanders in accordance with an exemplary embodiment disclosed herein.

Referring to FIG. 5, an enlarged view of the first expander 208 and the second expander 210 is illustrated. In the embodiment of FIG. 5, the valve 326 is coupled to the conduit 220 and comprises three openings of which a first opening is coupled to the casing 226 of the first expander 208, a second opening is coupled to the casing 228 of the second expander 210, and a third opening is coupled to the conduit 224 between the first expander 208 and the second expander 210. Although three openings are shown, in some embodiments not all three openings are present and in other embodiments additional openings may be used to supply working fluid to different locations of a single expander. In one embodiment, the second conduit supplies the condensed working fluid to the first expander 208 and the conduit 224 but not directly to the second expander 210. Referring back to the embodiment with three openings, the first expander 208 includes a casing 226, which houses a bearing 230, a shaft 232, and an impeller 234. The second portion of the working fluid which is fed thorough the conduit 220 is further diverted to at least one location in the casing 226. The conduit 220 is coupled at points 238, 240, 242, 244 and 246 in the casing 226 through branches 248, 250, 252, 254 and 256 which may be coupled to the second conduit 220 via one or more taps 258, 260,262, 264, and 266, for example. The flow of the second portion of the working fluid may be further controlled via flow regulating devices 268, 270, 272, 274, and 276 such as valves coupled in the branches 248, 250, 252, 254 and 256.

Similarly, the second expander 210 comprises a casing 228, which houses a bearing 278, a shaft 282, and an impeller 280. The second portion of the working fluid which is fed thorough the conduit 220 is further diverted and coupled to at least one location in the casing 228 at points 286, 288, 290, 292 and 294 through branches 296, 298, 300, 302 and 304. The branches are coupled to the second conduit 220 via one or more taps 306, 308, 310, 312, and 314, for example. The flow of the second portion of the working fluid may be further controlled via flow regulating devices 316, 318, 320, 322 and 324 such as valves coupled in the branches 296, 298, 300, 302, and 304.

The regulating devices 268, 270, 272, 274, and 276 of the first expander 208 and the regulating devices 316, 318, 320, 322 and 324 of the second expander 210 regulate the flow of the second portion of the working fluid based on the sensed temperature of the first expander components and second expander components. The temperature may be sensed by sensors 225, 229, 231 and 233 placed in or near the casing 226, the bearing 230, the shaft 232, and the impeller 234 respectively in the first expander 208 and the sensors 227, 277, 279 and 281 placed in or near the casing 226, the bearing 228, the impeller 280, and the shaft 282 respectively in the second expander 210. As discussed above with respect to FIG. 2, valves of the regulating devices may be fully opened, partially opened, or closed depending on the temperature of the corresponding expander components. Additionally, as discussed with respect to FIG. 2, as an alternative to using sensors, the temperatures of the expander components may be calculated based on the empirical experiments or model-based approach.

The control mechanism for valve 222 controls the flow based on the temperature of the expander components such as the bearings, the impellers, the casings and the shafts of the first and second expanders and in between the first expander and the second expander at point 224. The opening of the valve 326 depends on the amount of working fluid needed. In one example, either a portion or the entire amount of working fluid, which flows in the conduit 220, is diverted to point 224 in between the first expander and the second expander. The flow coming out from the expander 208 is thus mixed with the lower temperature working fluid in this embodiment. The addition of the lower temperature working fluid reduces the inlet temperature at expander 210 and increases the volume flow of the working fluid flowing into the expander 210, thus increasing the power output of the expansion stage in the expander 210. In one embodiment, the amount of working fluid, which flows in the conduit 220, is about 15% of the mass flow of the working fluid circulating in the ORC system 200.

Figure 6:
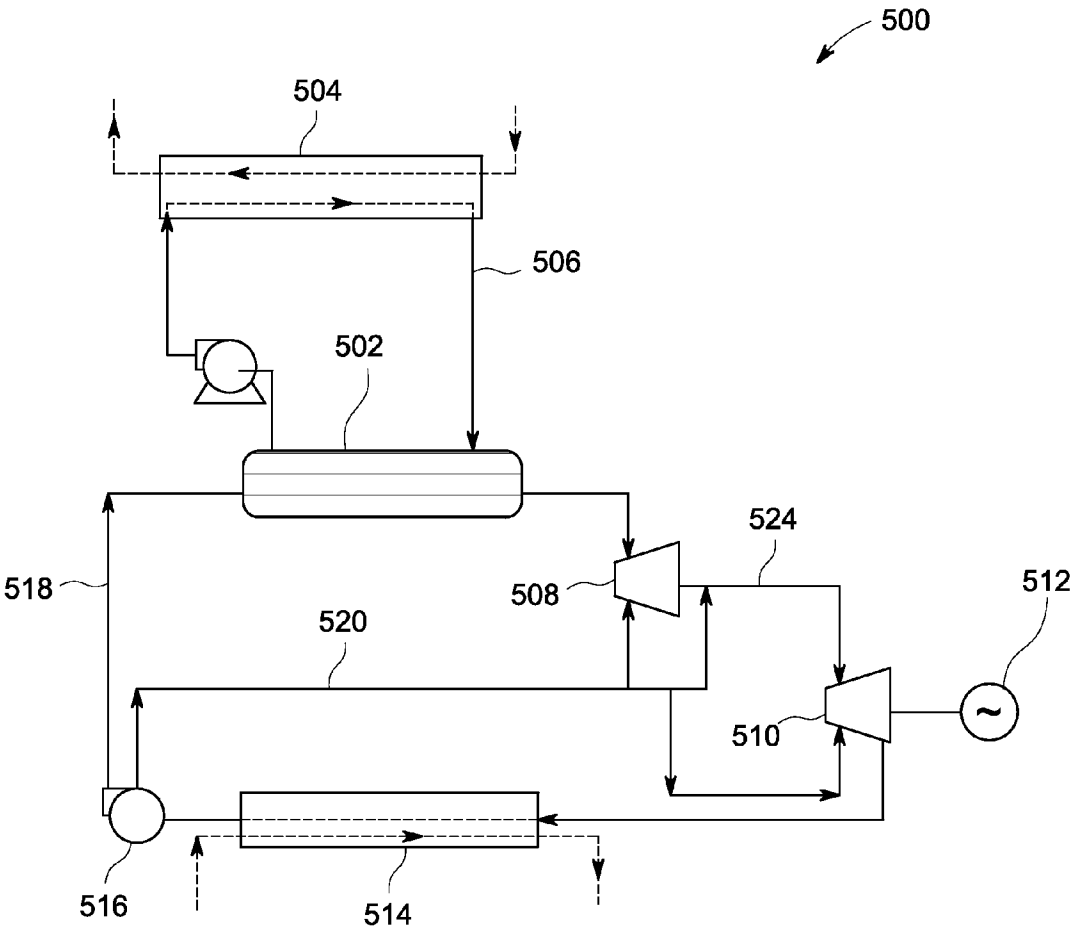
FIG. 6 is a diagrammatical representation of an ORC system having two expanders in accordance with another exemplary embodiment disclosed herein.

Referring to FIG. 6, an ORC system 500 is illustrated in accordance with another exemplary embodiment of the present invention. The illustrated ORC system 500 includes an evaporator 502 through which organic working fluid is circulated. The evaporator 502 is coupled to a heat source 504 such as, for example, an exhaust heat exchanger coupled to an engine. The evaporator 502 receives heat from the exhaust gas generated from the heat source 504 via an intermediate loop 506 and generates a vaporized organic working fluid. The vaporized organic working fluid is passed through a first expander 508. The second expander 510 is in flow communication with the first expander 508 and configured to expand the organic working fluid fed from the first expander 508 to drive a first generator 512. After passing through the second expander 510, the organic working fluid vapor is passed through the condenser 514. A pump 516 is coupled in flow communication with the condenser 514 and configured to pump the working fluid fed from the condenser 514. In the illustrated embodiment, the pump 516 has two openings 518 and 520 to feed the condensed working fluid. The pump 516 has a first opening 518 to feed a first portion of the working fluid to the evaporator 502 and a second opening 520 to feed a second portion of the working fluid to at least one of the first expander 508, the second expander 510, and a conduit 524 in between the first expander and the second expander 524 via a second conduit 220.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A Rankine cycle system, comprising:

an evaporator configured to receive heat from a heat source and circulate a working fluid to remove heat from the heat source;

an expander in flow communication with the evaporator and configured to expand the working fluid fed from the evaporator;

a condenser in flow communication with the expander and configured to condense the working fluid fed from the expander;

a pump in flow communication with the condenser and configured to pump the working fluid fed from the condenser, a first conduit for feeding a first portion of the working fluid from the pump to the evaporator; and a second conduit for feeding a second portion of the working fluid from the pump directly to the expander, wherein the second portion of the working fluid is fed to at least one location in the expander, and wherein the expander comprises a multi-stage expander and the at least one location comprises a location in-between two stages of the multi-stage expander.

2. The system of claim 1, wherein the working fluid comprises an organic working fluid.

3. The system of claim 2, wherein the expander comprises expander components, and wherein the second portion of the working fluid is fed to the expander to cool at least one of the expander components.

4. The system of claim 3, wherein the expander components comprise a casing, a bearing, a shaft, and an impeller, and wherein the bearing, the shaft, and the impeller are disposed in the casing.

5. The system of claim 4, further comprising a coupling device, wherein the second conduit is coupled to the expander via the coupling device.

6. The system of claim 4, further comprising a regulating device configured to control the flow of the second portion of the working fluid fed to the expander.

7. The system of claim 6, wherein the regulating device is configured to control the flow of the second portion of the working fluid fed to the expander based on a temperature of at least one of the expander components.

8. The system of claims 7, further comprising a temperature sensor for obtaining the temperature of the at least one of the expander components.

9. The system of claim 1, wherein the second portion of the condensed working fluid comprises 0.3% to 1% of a mass flow of the working fluid circulated in the Rankine cycle system.

10. A Rankine cycle system, comprising:

an evaporator configured to receive heat from a heat source and circulate a working fluid to remove heat from the heat source;

an expander in flow communication with the evaporator and configured to expand the working fluid fed from the evaporator;

a condenser in flow communication with the expander and configured to condense the working fluid fed from the expander;

a pump in flow communication with the condenser and configured to pump the working fluid fed from the condenser, a first conduit for feeding a first portion of the working fluid from the pump to the evaporator; and a second conduit for feeding a second portion of the working fluid from the pump directly to the expander, wherein the second portion of the working fluid is fed to at least one location in the expander, and wherein the expander comprises a multi-stage expander and the at least one location comprises at least two locations with a first location comprising a location corresponding to a position of at least one expander component and a second location comprising a location in-between two stages of the multi-stage expander.

11. A method of operating a Rankine cycle system, comprising circulating a working fluid in an evaporator in heat exchange relationship with a heat source so as to vaporize the working fluid;

expanding the vaporized working fluid in an expander, wherein the expander comprises a multi-stage expander;

condensing the expanded working fluid via a condenser fed from the expander;

pumping the condensed working fluid, supplying a first portion of the pumped working fluid to the evaporator; and supplying a second portion of the pumped working fluid directly to at least one location in the expander, wherein the at least one location comprises a location in-between two stages of the multi-stage expander.

* * * * *